United States Patent [19]

Grant

[11] 4,091,267

[45] May 23, 1978

[54] SELF-REGULATING ELECTRIC HEATER

[75] Inventor: John L. Grant, Halifax, Mass.

[73] Assignee: Texas Instruments Incorporated, Dallas, Tex.

[21] Appl. No.: 706,368

[22] Filed: Jul. 19, 1976

[51] Int. Cl.[2] ..... H05B 3/02; H01C 7/02

[52] U.S. Cl. ..... 219/544; 219/505; 219/536; 219/541; 338/22 R; 338/274

[58] Field of Search ..... 219/504, 505, 541, 544, 219/536, 336, 338, 548, 209, 210, 538; 174/52 PE; 338/22 R, 25, 23, 28, 248, 250, 253, 269, 275, 274

[56] References Cited

U.S. PATENT DOCUMENTS

| | | | |
|---|---|---|---|
| 2,357,072 | 8/1944 | Beck et al. | 338/275 X |
| 2,562,791 | 7/1951 | Imobersteg | 219/541 |
| 3,286,214 | 11/1966 | Kolb et al. | 338/269 |
| 3,824,328 | 7/1974 | Ting et al. | 219/504 X |
| 3,940,591 | 2/1976 | Ting | 219/536 |
| 3,996,447 | 12/1976 | Bouffard et al. | 338/22 R X |

*Primary Examiner*—Thomas J. Kozma
*Attorney, Agent, or Firm*—John A. Haug; James P. McAndrews

[57] ABSTRACT

A high efficiency, self-regulating temperature-controlling fluid sump heater for external mount or internal well use comprising a D-shaped thermally conductive housing having a chamber therein and a plurality of heating elements in the chamber. The heating elements are self-heating, positive temperature coefficient (PTC) resistors having low initial resistance which increases abruptly as their temperature rises above a given level. The elements have first and second substantially parallel surfaces spaced one from another, these surfaces each having a layer of electrically conductive material applied thereto for forming on ohmic contact. The heater further comprises two heat sink plates of thermally and electrically conductive material, the plates being positioned to engage the first and second surfaces of the elements and to extend nearly the whole length of the housing with one plate adjacent the flat wall of the D-shaped housing. First and second terminal means are carried by the plates for supplying electrical power to the elements. The chamber is filled with an electrically insulating thermally conductive ceramic for providing better heat transfer while avoiding degradation of the PTC resistors.

4 Claims, 6 Drawing Figures

SELF-REGULATING ELECTRIC HEATER

BACKGROUND AND SUMMARY OF INVENTION

This invention relates to self-regulating heaters and more particularly to self-regulating heaters for interior well or exterior mount use for a refrigeration system compressor housing to maintain the lubricant therein above a predetermined temperature level.

In conventional refrigeration compressors, a refrigerant, such as one sold under the trademark "Freon" by E. I. du Pont de Nemours & Co., may, in liquid form, migrate from the condenser into the compressor lubricant. Then, when start-up of the compressor occurs, the sudden reduction in crankcase pressure may cause the refrigerant to boil, thus causing the lubricant to foam with consequent loss of lubrication to other mechanical parts of the compressor. It has been conventional to employ a crankcase heater to maintain the compressor crankcase at a temperature above that of the rest of the refrigeration system which prevents the migration of refrigerant into the crankcase lubricant.

In the prior art, fixed constant-resistance heaters were used for heating the crankcase. However, these heaters were not self-regulating and thus required heat output temperature controls and the expense and low reliability associated with them. Self-regulating sump heaters such as disclosed in the co-assigned U.S. Pat. Nos. 3,564,199, 3,748,439, and 3,940,591 have proven useful in many applications. These self-regulating heaters employed a heater made of ceramic material having a positive temperature coefficient (PTC) of resistivity. Such heaters have a relatively low resistance at usual ambient temperatures, but after initial energization by a source of electrical power will self-heat and increase their temperature and resistance. Heat will be generated and the resistance will increase rapidly above a threshold or anomaly temperature until the heat generated balances the heat dissipated at which time the temperature and resistance stabilize with the resistance many times the initial value.

Many prior art self-regulating heaters have had a thermal resistance of the device which is higher than desired. For example, these devices were made with a plastic housing and not filled with thermally conductive material because of the deleterious affect of epoxy on the PTC material. As a result a large PTC pill was needed to provide the heat required adding to the cost to manufacture and if attached externally also to the cost of operation. Additionally prior art devices used a different design depending on whether their use was internal or external.

Accordingly, it is an object of the present invention to provide an improved self-regulating heater.

It is another object to provide a self-regulating heater which can be used both in an internal well and as externally mounted for heating crankcase lubricant.

It is a further object to provide a self-regulating heater with a low thermal resistance.

It is still another object to provide a self-regulating heater which is easy to assemble, inexpensive in construction and reliable in operation. Other objects and features of this invention will be in part apparent and in part pointed out hereinafter.

Briefly, the self-regulating heater of this invention comprises a D-shaped thermally conductive ceramic tube with a cap at one end defining a chamber therein.

The chamber contains a high thermal conductivity ceramic based potting compound and a self-regulating heater member. The heating member comprises a plurality of PTC heating elements which are sandwiched between two heat sink plates of thermally and electrically conductive material. The plates preferably are of such a width to fit into the chamber and of such a length to extend past the respective ends of the elements to run nearly the entire length of the ceramic tube. One of the plates is positioned directly adjacent the internal flat portion of the D-shaped tube. A plurality of projections are provided on the plates to ensure good electrical connection between the elements and the plates when being secured together with a thermally conductive adhesive while also providing large enough gaps between the plates and the elements so that the adhesive can fill the gaps and avoid entrapped air. First and second terminal means are attached to the plates for supplying electrical power to the elements. After partial filling of the chamber with the ceramic potting compound and inserting the heating member with terminal means, the end of the tube opposite the cap is sealed with an RTV (Room Temperature Vulcanizing) silicone rubber compound to provide a water tight device.

The design of the heater provides for a low resistance device which can be mounted both internally and externally to a crankcase of compressor as well as easily and economically assembled. The D-shaped housing provides for easy insertion of the heating member and preferential location of one of the plates adjacent the flat wall housing. When using the heater externally the heater is attached with this flat portion of the D directly against the outside of the crankcase wall to provide maximum heat thereto. The low thermal resistance of the heater allows for the use of small heating elements which reduce manufacturing cost and in the case of the externally attached device also operating cost.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
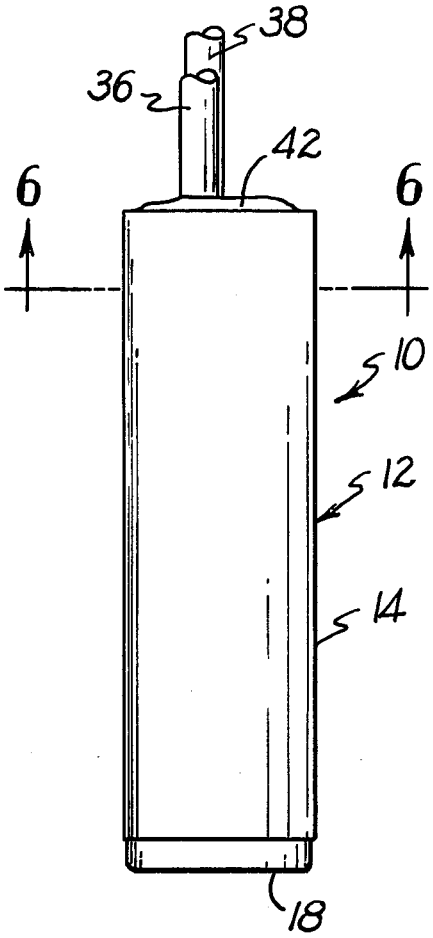
FIG. 1 is a front plan view of a self-regulating heater of this invention.

Referring now to drawings 1 and 2, a self-regulating heater 10 of this invention is shown with a housing member 12. Housing member 12 is preferably made from an extruded D-shaped tube 14 as best shown by FIG. 6 and a ceramic cap 18, both of which are made from an electrically insulating, thermally conductive material such as steatite. Cap 18 is secured to one end of tube 14 to define a chamber 20 therein with an open end. Cap 18 may be secured to the tube with any suitable ceramic adhesive such as that commercially sold as Dow Corning 140. The housing 12 has a flat surface portion 13 and a major circular portion 15 with round corners or minor circular portions where the major circular portion meets the flat portion. The use of the D-shaped housing as more fully explained below allows for economical manufacture, and easy assembly while providing a design with excellent thermal conductivity which can be effectively used both when internally or externally mounted to an oil sump 16 of a compressor as respectively shown by FIGS. 4 and 5.

A self-regulating heating member is illustrated by numeral 22. Heating member 22 preferably includes a plurality of self-regulating heater elements 24 which are a self-heating positive temperature coefficient (PTC) resistor of a ceramic material, e.g., a doped barium titanate, having low initial resistance which increases abruptly as the temperature rises above a given anomaly temperature until it reaches its equilibrium temperature. At its equilibrium temperature, the heat generated by the elements is equal to the heat dissipated. Reference may be made to the above-mentioned U.S. patents for a more detailed description of PTC heating elements and their resistivity characteristics. The heating elements have first and second substantially parallel surfaces 26 and 28 respectively spaced from one another by the thickness of the element. These surfaces each have a layer of electrically conductive material 27 and 29 applied thereto for forming an ohmic contact surface. This conductive material does not extend along the sides of the element.

Figure 3:
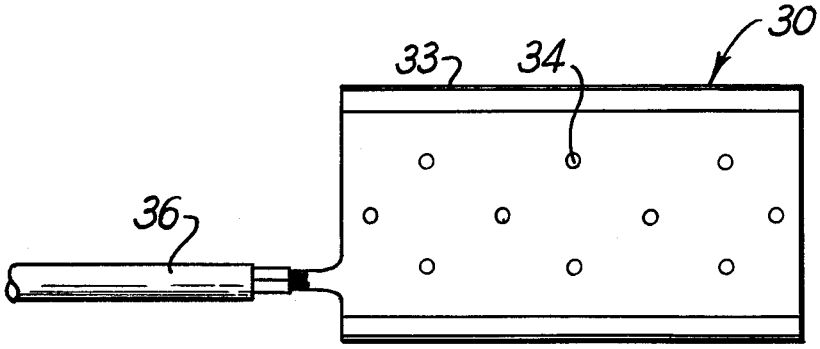
FIG. 3 is an enlarged plan view of a heat transfer plate and terminal means of the heater of this invention.

A pair of heat sink plates 30 and 32 as best shown by FIG. 3 of an electrically and thermally conductive material (e.g., copper) are positioned to engage the parallel surfaces 26 and 28 of the heating elements. Plates 30 and 32 have width so as to fit slidingly into chamber 20. That is, to be freely slidable in and out of the chamber while still being guided by the side walls around the chamber. The length of the plates extend substantially beyond the ends of the respective elements running nearly the entire length of chamber 20 to provide better heat conductivity throughout the device. Preferably the plates also have a rolled edge 33 along the length to provide easy assembly. A plurality of small projections 34 are provided on plates 30 and 32 as best shown by FIG. 3 to insure good surface contact between the plate and the conductive surface of the elements. Additionally these projections insure that there will be enough gap between the plate and elements in areas where they do not contact so that a thermally conductive adhesive used to join them can fill in the gap and avoid entrapped air and consequential heat conductivity loss.

Figure 2:
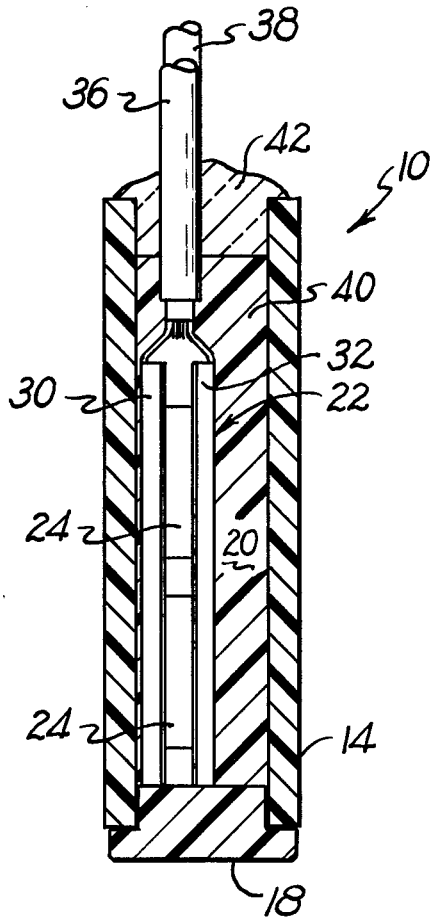
FIG. 2 is a section view of the self-regulating heater of FIG. 1.

As best shown by FIGS. 2 and 3, first and second terminals 36 and 38 are carried by plates 30 and 32 respectively, for supplying electrical power to heating elements 24.

Accordingly chamber 20 is substantially filled with a ceramic potting compound, such as a densely filled phospate or silicate bonded aluminum oxide compound. The compound is chemically set and forms an electrically non-conductive ionized species during curing with a high dielectric strength without firing, and is free from reducing agents such as amines found in epoxy curing agents which cause degradation of the PTC. Strongly polarized ions in the compound make a strong bond to tube 14 providing excellent thermal conductivity between the two. Specifically Aremco 510 manufactured by Aremco Products, Inc. has been found to be an excellent compound with a thermal conductivity in the range of 25 BTU inches/hr° F ft$^2$.

Heating member 22 with elements 24, plates 30 and 32 and terminals 36 and 38 are inserted into the chamber 20 and compound 40 prior to the compound curing. The D-shape of the tube preferentially locates member 22 directly adjacent flat wall portion 13 while still providing sufficient clearance for easy insertion of the member and complete flow of ceramic compound 40 around it to leave no air pockets. More specifically the D-shaped housing chamber positions one plate directly adjacent an inner face of the flat housing surface portion and the edges of the second plate adjacent an inner face of the major circular housing portion. The ceramic compound 40 cured in situ holds the member 22 in place. The level of the compound in chamber 20 is provided to completely cover the heating member while also covering the bottom portion of terminal means 36 and 38 as shown by FIG. 2.

Accordingly a water tight seal 42 of RTV is provided to fill the top portion of the tube. The RTV adheres to the inside of the ceramic tube to provide a heater capable of being used when immersed in water.

Figure 4:
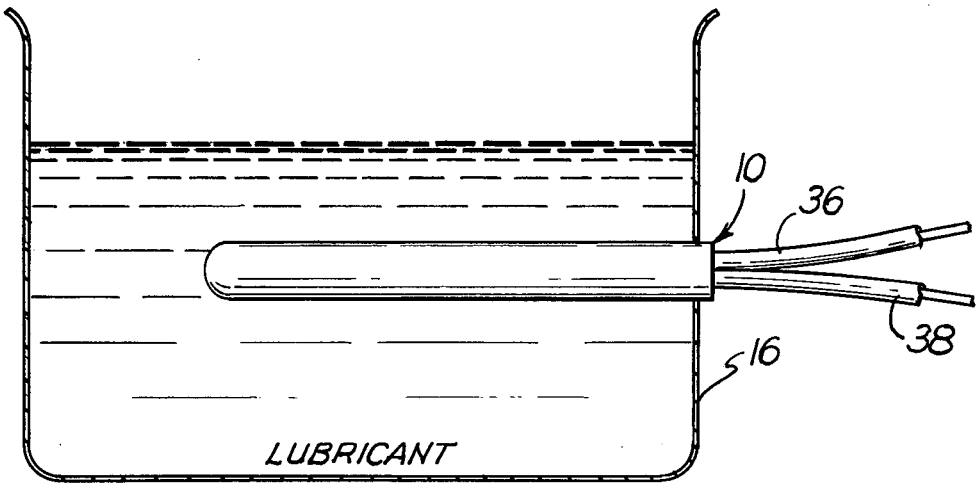
FIG. 4 is a plan view of the heater of this invention as it is internally applied to a refrigeration compressor crankcase.

In accordance with this invention heater 10 is adapted for internal well use in the oil sump 16 of the compressor as shown in FIG. 4. The low thermal resistance of the device typically allows for the use of two small PTC pills (0.500 diameter × 0.200 thick) as heating elements which makes the device inexpensive to manufacture.

Figure 5:
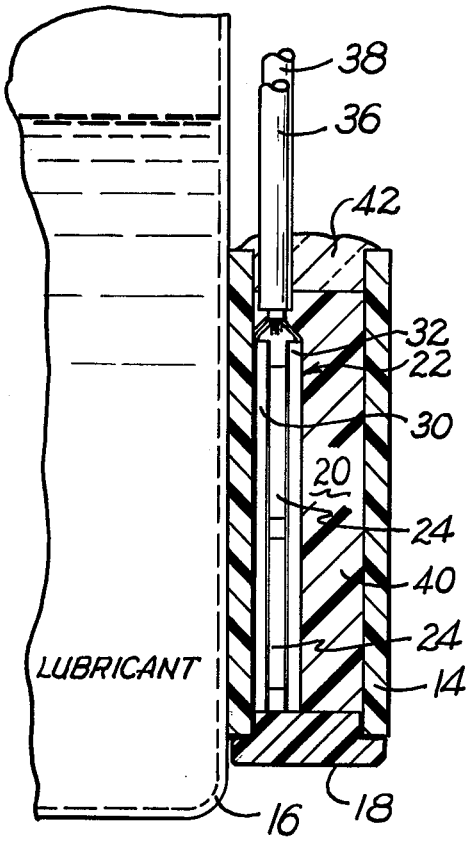
FIG. 5 is a section view of the heater of this invention as it is externally applied to the compressor crankcase.
Figure 6:
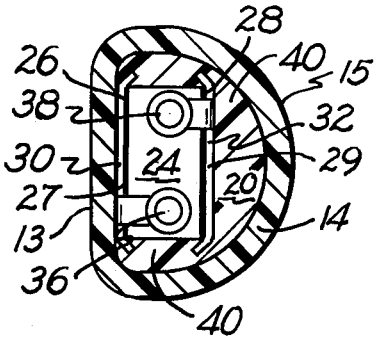
FIG. 6 is a horizontal cross-sectional view taken on line 6—6 of FIG. 1.

In accordance with this invention heater 10 is also adapted to be externally mounted to the oil sump 16 of the compressor as shown by FIG. 5. The heater 10 with the flat portion of the D-shaped tube against the oil sump may be adhered thereto by means of thermally conductive adhesive tape strips of aluminum foil or by clamping means and thermally conductive adhesive. It the thermally conductive tape strips are used, they are positioned to form an X with one strip under the flat portion of the D and the other strip running around the tube. If the clamping means and thermally conductive adhesive are used, the clamping means is used to hold the flat surface of the heater 10 flush against the oil sump with the adhesive packed around the device to ensure good thermal conductivity between the heater and the sump. With either method of adhereing the heater to the sump, the heat not only comes from heat sink plate 30 adjacent the flat side of the D-shaped tube but also from the other heat sink plate 32 through the thermally conductive potting compound and housing and thermally conductive adhereing means. The low thermal resistance of the device allows the maximum amount of heat generated by the heater to reach the oil sump.

Accordingly, an easily assembled heater has been shown for both internal well and external mount use to heat an oil sump of a compressor. The low thermal resistance of the package and simplicity of design provides a device which is inexpensive to manufacture and efficient in use.

In view of the above, it will be seen that the several objectives of the invention are achieved and other advantageous objects attained.

As various changes could be made in the above constructions without departing from the scope of the invention, it is intended that all matter contained in the above description or shown in the accompanying drawings shall be interpreted as illustrative and not in a limiting sense.

I claim:

1. A self-regulating heater for heating a fluid sump comprising:

a thermally conductive, electrically insulating tubular housing of a ceramic material having a closed end and an open end and having a D-shaped cross section including a first wall portion with flat inner and outer surfaces and with a second wall portion with inner and outer major circular surfaces and having said first and second wall portions joined by two other wall portions each with inner and outer minor circular surfaces for defining a chamber therein of comparable D-shaped cross-section;

a heater assembly incorporating a heating means constituted by at least one self-heating positive temperature coefficient resistor element having low initial resistance which increases abruptly as its temperature rises above a given level, said element having first and second substantially parallel opposite surfaces each having a layer of electrically conductive material applied thereto forming an ohmic contact surface thereon, said assembly further incorporating a pair of heat sink plates of thermally and electrically conductive material secured in contact with respective ohmic contact surfaces of said resistor element with said plates having a width greater than said heating means and a length greater than said heater means, said assembly having a sliding fit in said D-shaped housing chamber for disposing one plate directly adjacent said inner flat surface of said first housing wall portion and for disposing edges of the second plate adjacent said inner major circular surface of said second housing wall portion for locating the assembly in said chamber;

a thermally conductive electrically insulating ceramic filler cured in situ within the chamber to substantially fill said chamber around said assembly free of entrapped gases for providing excellent heat transfer between the assembly and said housing;

terminal means connected to respective plates and extending from the open housing end for supplying electrical power to said element; and a potting material filling the remainder of the volume of the housing chamber around said terminal means at the open housing end sealing said chamber.

2. A self-regulating heater as set forth in claim 1 further providing that said thermally conductive electrically insulating ceramic is a densely filled phosphate bonded aluminum oxide compound.

3. A self-regulating heater as set forth in claim 2 wherein said heat sink plates include a plurality of projections to insure good electrical surface contact between the plates and said ohmic contact surfaces of said element.

4. A self-regulating heater as set forth in claim 3 further including a thermally conductive adhering means to hold said flat side against said fluid sump.

* * * * *